US008070317B2

(12) United States Patent
Zhang et al.

(10) Patent No.: US 8,070,317 B2
(45) Date of Patent: Dec. 6, 2011

(54) LED ASSEMBLY

(75) Inventors: Hai-Wei Zhang, Shenzhen (CN); Yi-San Liu, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 268 days.

(21) Appl. No.: 12/581,177

(22) Filed: Oct. 19, 2009

(65) Prior Publication Data

US 2011/0032701 A1 Feb. 10, 2011

(30) Foreign Application Priority Data

Aug. 4, 2009 (CN) ..... 2009 1 0305175

(51) Int. Cl.
*F21V 21/00* (2006.01)

(52) U.S. Cl. ..... 362/249.02; 362/249.14

(58) Field of Classification Search ..... 326/227, 326/236, 237, 238, 240, 244, 246, 249.01, 326/249.02, 249.14, 253, 257, 285, 308–310, 326/311.01, 311.02, 311.14, 319, 326, 329, 326/540, 543–545, 800, 806, 812; 40/541, 40/542, 564, 57; 349/57, 61, 62, 95; 345/1.1, 345/1.3, 46, 55, 903; 257/98–100, 678, 704, 710, 711, 730–733
See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 4,345,308 | A * | 8/1982 | Mouyard et al. | 362/332 |
| 5,722,760 | A * | 3/1998 | Chien | 362/84 |
| 6,683,325 | B2 * | 1/2004 | Waitl et al. | 257/81 |
| 6,970,491 | B2 * | 11/2005 | Bhandarkar | 372/43.01 |
| 7,682,051 | B2 * | 3/2010 | Xiao et al. | 362/364 |
| 7,780,318 | B2 * | 8/2010 | Xiao et al. | 362/371 |
| 2007/0068055 | A1 * | 3/2007 | Segan et al. | 40/544 |

* cited by examiner

*Primary Examiner* — Hargobind S Sawhney
(74) *Attorney, Agent, or Firm* — Altis Law Group, Inc.

(57) ABSTRACT

An LED assembly includes a plurality of LED modules, a plurality of individual lenses and a pressing plate. Each LED module has a printed circuit board and a plurality of LEDs attached to the printed circuit board. Each lens covers a corresponding LED. Each lens includes a supporting base and a light adjusting portion disposed on the supporting portion. The pressing plate defines a plurality of through holes corresponding to the light adjusting portions of the lenses. The lenses cooperates with the LEDs. The light adjusting portions of the lenses extend through the through holes of the pressing plate. The pressing plate presses peripheral portions of the supporting bases towards the printed circuit boards of the LED modules.

10 Claims, 5 Drawing Sheets

LED ASSEMBLY

BACKGROUND

1. Technical Field

The disclosure relates to an illuminating device and, more particularly, to an LED (light emitting diode) assembly.

2. Description of Related Art

LEDs (light emitting diodes), available since the early 1960's, have been increasingly used in a variety of application fields and are intended to be a high quality replacement for conventional light sources due to high light-emitting efficiency, environmental friendliness, and low power consumption.

A typical LED lamp includes a housing and a plurality of LEDs disposed in the housing. Each of the LEDs includes an LED die and a transparent encapsulant enveloping the LED die for adjusting light emitted from the LED die. However, due to the size limitation of the encapsulant, the encapsulant cannot effectively adjust light generated by the LED die whereby a light pattern of the LEDs cannot satisfy some illumination requirements. Therefore, light-adjusting devices are utilized for further adjustment of the light emitted from the LED die. A typical light-adjusting device includes a main body having a plurality of lenses integrally formed thereon. The main body of the light-adjusting device is mounted over the LEDs. Each LED is corresponding to one of the lenses so that the light emitted from each LED is further adjusted by a corresponding lens.

However, in assembly of the light-adjusting device, the main body of the light-adjusting device must be accurately mounted over these LEDs of the LED lamp to make sure that each lens is accurately corresponding to one of the LEDs. By doing this, the light-adjusting device adjusts light emitted from the LEDs to form a perfect light pattern. Once assembly errors of the light-adjusting device exist, it is unavoidable that the lenses can not be in alignment with corresponding LEDs, which results in that the adjusted light pattern cannot satisfy the demands of illumination.

What is needed, therefore, is an LED assembly which can overcome the above-mentioned problem.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
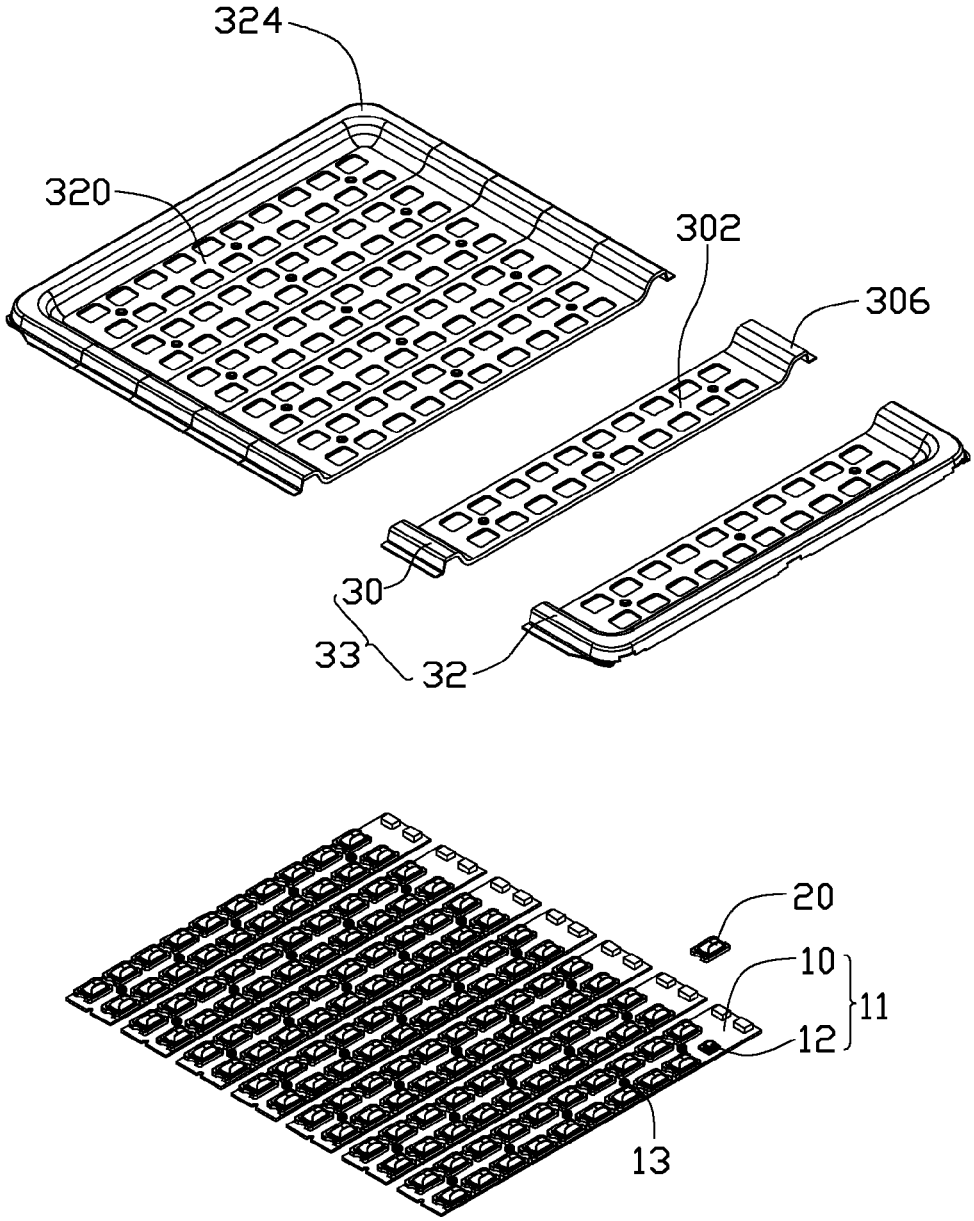
FIG. 1 is an isometric, exploded view of an LED assembly in accordance with an embodiment of the disclosure.

Referring to FIG. 1, an LED (light emitting diode) assembly is illustrated in accordance with an embodiment of the disclosure. The LED assembly includes a plurality of LED modules 11, a plurality of individual lenses 20 placed on the LED modules 11, and a pressing plate 33 pressing the lenses 20 on the LED modules 11. Each of the LED modules 11 includes a flat, rectangular printed circuit board 10 and a plurality of LEDs 12 attached to a top surface of the printed circuit board 10. An amount of the lenses 20 is identical to that of the LEDs 12. Each lens 20 cooperates with a corresponding LED 12 to adjust light emitted from the corresponding LED 12. The pressing plate 33 presses these lens 20 on the printed circuit boards 10 of the LED modules 11.

Figure 2:
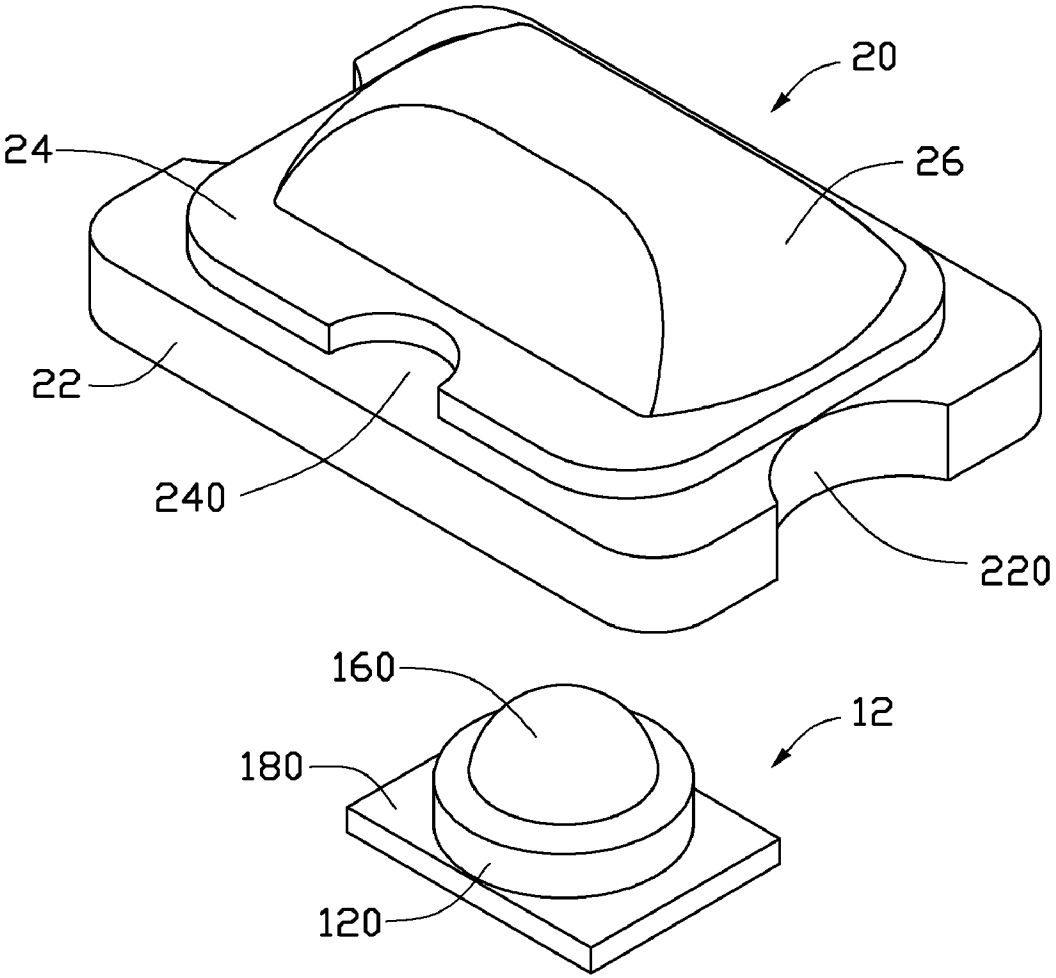
FIG. 2 is an isometric, enlarged view of a lens and a corresponding LED, in separated relation, of the LED assembly of FIG. 1.

Also referring to FIG. 2, each LED module 11 is rectangular in shape. The LEDs 12 of each LED module 11 are arranged into two spaced rows along a length direction of the printed circuit board 10. Each LED 12 includes a rectangular base 180, a cylindrical substrate 120 extending upwardly from a top surface of the base 180 and a transparent encapsulant 160 enveloping a center of a top of the substrate 120. An LED die (not shown) is enveloped in the encapsulant 160. The encapsulant 160 may be dome-shaped for being acted as a primary convex lens to distribute light emitted from the LED die into a hemispherically diverged pattern.

Each lens 20 is integrally made of a light-permeable material, such as PC or PMMA. Each lens 20 includes a substantially rectangular supporting base 22 having two arc cutouts 220 defined at two opposite short sides thereof, a substantially rectangular connecting portion 24 extending upwardly from a top surface of the supporting base 22 and a light adjusting portion 26 extending upwardly from a top surface of the connecting portion 24. The connecting portion 24 has an arc cutout 240 defined at an elongated side thereof for indicating and ensuring correct assembly orientation of the lens 20. The light adjusting portion 26 has an elongated configuration, extending along a lengthwise direction of the connecting portion 24. The light adjusting portion 26 is spaced a distance from the elongated side of the connecting portion 24 in which the arc cutout 240 is defined, and close to another elongated side of the connecting portion 24, thereby adjusting light emitted from a corresponding LED 12 into an elongated light pattern. In other embodiments, no cutouts 220 are defined at the two opposite short sides of the supporting base 22. In this embodiment, the connecting portion 24 is disposed at a center portion of the supporting base 22. The light adjusting portion 26 has a bottom surface smaller than that of the connecting portion 24.

Figure 3:
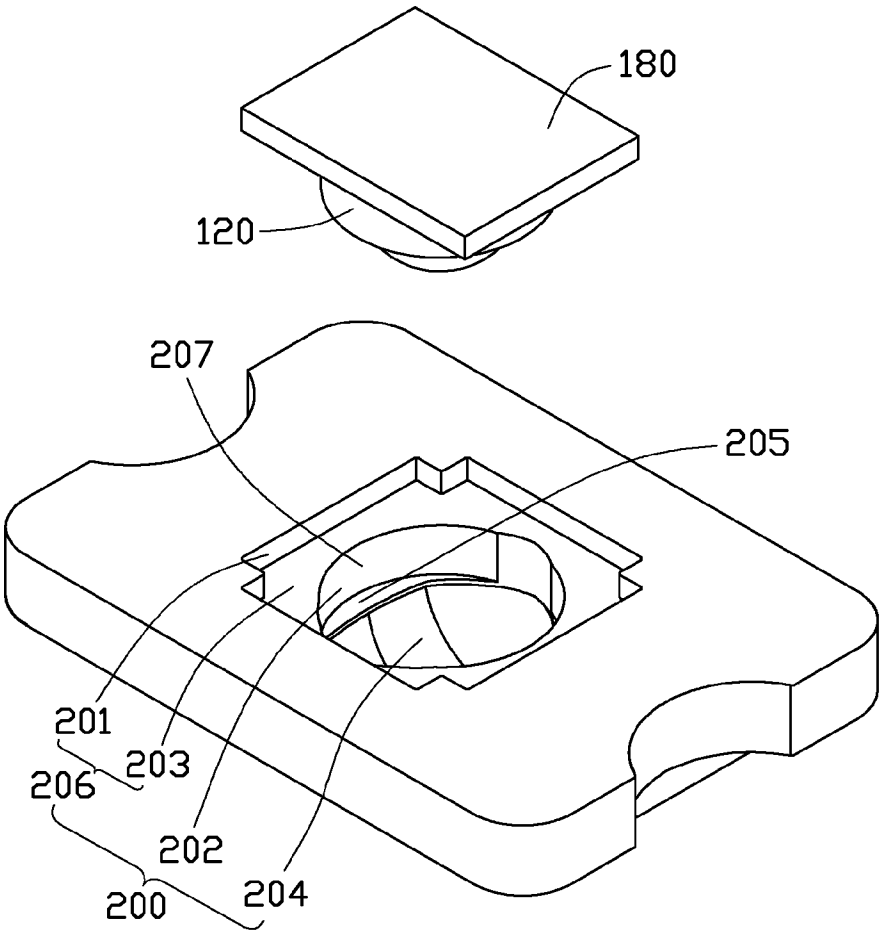
FIG. 3 is an inverted view of FIG. 2.

Also referring to FIG. 3, each lens 20 defines a cavity 200 at a bottom of the supporting base 22 thereof for receiving the corresponding LED 12 therein. The cavity 200 includes a first positioning groove 206, two opposite second positioning grooves 202 and a receiving groove 204.

The first positioning groove 206 includes two crossed rectangular grooves 201, 203. The grooves 201, 203 are the same as and perpendicular to each other. The groove 201 has an area identical to that of the base 180 of the corresponding LED 12, thereby receiving the base 180 in the groove 201. The base 180 of the corresponding LED 12 may be selectively received in one of the grooves 201, 203 according to actual needs, whereby the lens 20 may be positioned at a selected one of two mutually perpendicular orientations for projecting the light emitted from the corresponding LED 12 towards the selected one of the two orientations. When the base 180 of the corresponding LED 12 is fittingly received in one of the grooves 201, 203, the base 180 of the LED 12 and accordingly the LED 12 are blocked by the supporting base 22 of the lens 20 from rotation and lateral movement.

The receiving groove 204 is defined above and communicated with the first positioning groove 206. The receiving groove 204 is ellipsoid in shape and has two opposite elongated sides thereof expanding outwardly towards the opposite short sides of the supporting base 22 of the lens 20 to form the second positioning grooves 202. Each second positioning groove 202 includes a substantially crescent surface 205 and a cylinder surface 207. When the corresponding LED 12 is received in the cavity 200 of the lens 20, a periphery of the substrate 120 of the corresponding LED 12 abuts the cylinder surfaces 207 for further limiting the lens 20 from moving in the plane parallel to the bottom surface of the base 180 of the corresponding LED 12, and a top surface of the substrate 120 of the corresponding LED 12 abuts the crescent surfaces 205. The encapsulant 160 of the corresponding LED 12 is received in the receiving groove 204 of the cavity 200.

In other embodiments, the first positioning groove 206 of the cavity 200 of the lens 20 may be formed by two grooves 201, 203 each having other shapes, such as triangle, ellipse and so on. The shapes of the grooves 201, 203 depend on that of the base 180 of the corresponding LED 12. The grooves 201, 203 have an angle therebetween smaller than 90 degrees and larger than 0 degree. The angle between the grooves 201, 203 depends on actual demands.

Referring to FIG. 1 again, the pressing plate 33 is rectangular in shape, and has a top surface coated with retro-reflective material. The pressing plate 33 includes a plurality of first pressing plates 30 and two second pressing plates 32. The first pressing plates 30 are disposed at a center portion of the pressing plate 33, and the second pressing plates 32 are disposed at two opposite lateral sides of the first pressing plates 30.

Each of the first pressing plates 30 includes a substantially plate-shaped main body 302, and two bent portions 306 extending outwardly from two opposite ends of the main body 302. Each of the second pressing plates 32 includes a substantially plate-shaped main body 320, and a bent portion 324 extending outwardly from there outer lateral sides of the main body 320. The main bodies 302, 320 of the first, second pressing plates 30, 32 abut each other side by side to cooperatively form a main body of the pressing plate 33. The bent portions 306, 324 of the first, second pressing plates 30, 32 abut each other to cooperatively form a bent portion enclosing the main body of the pressing plate 33.

Figure 4:
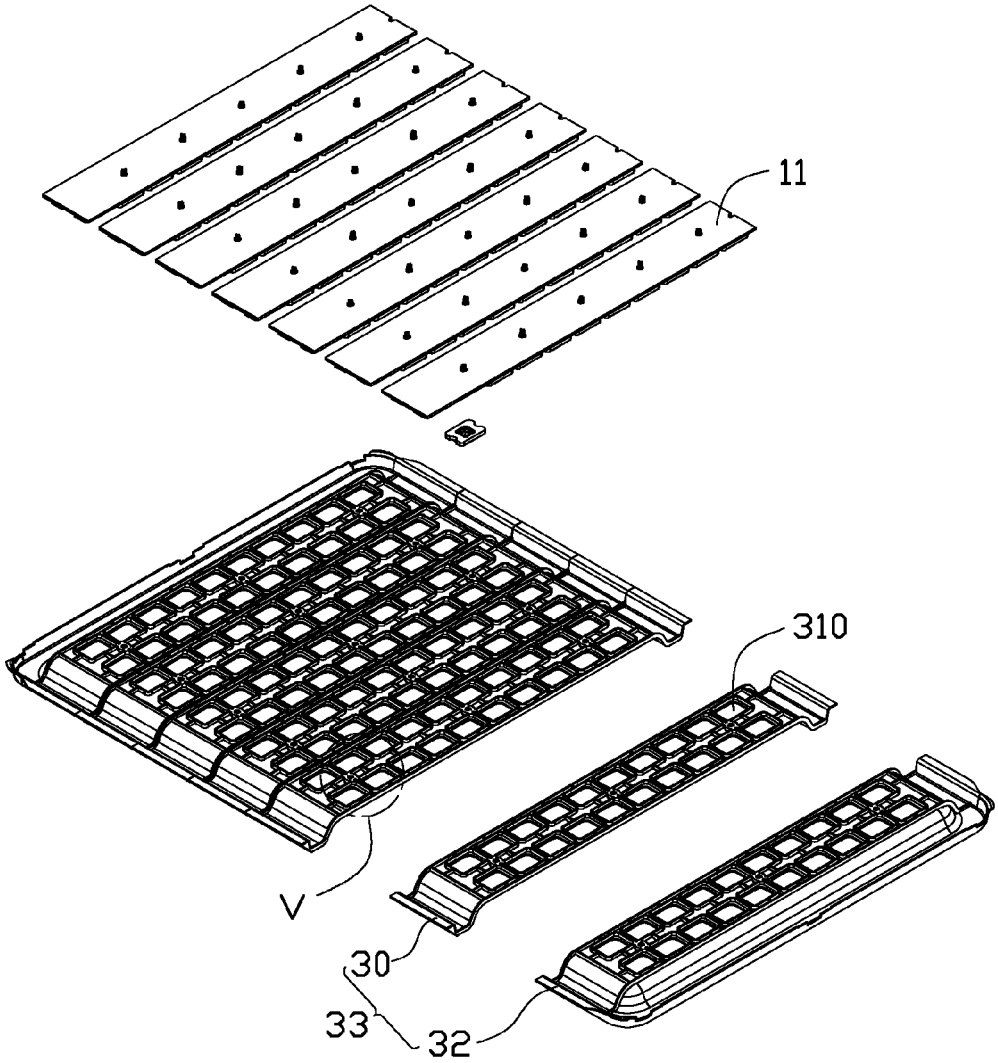
FIG. 4 is an inverted view of FIG. 1.
Figure 5:
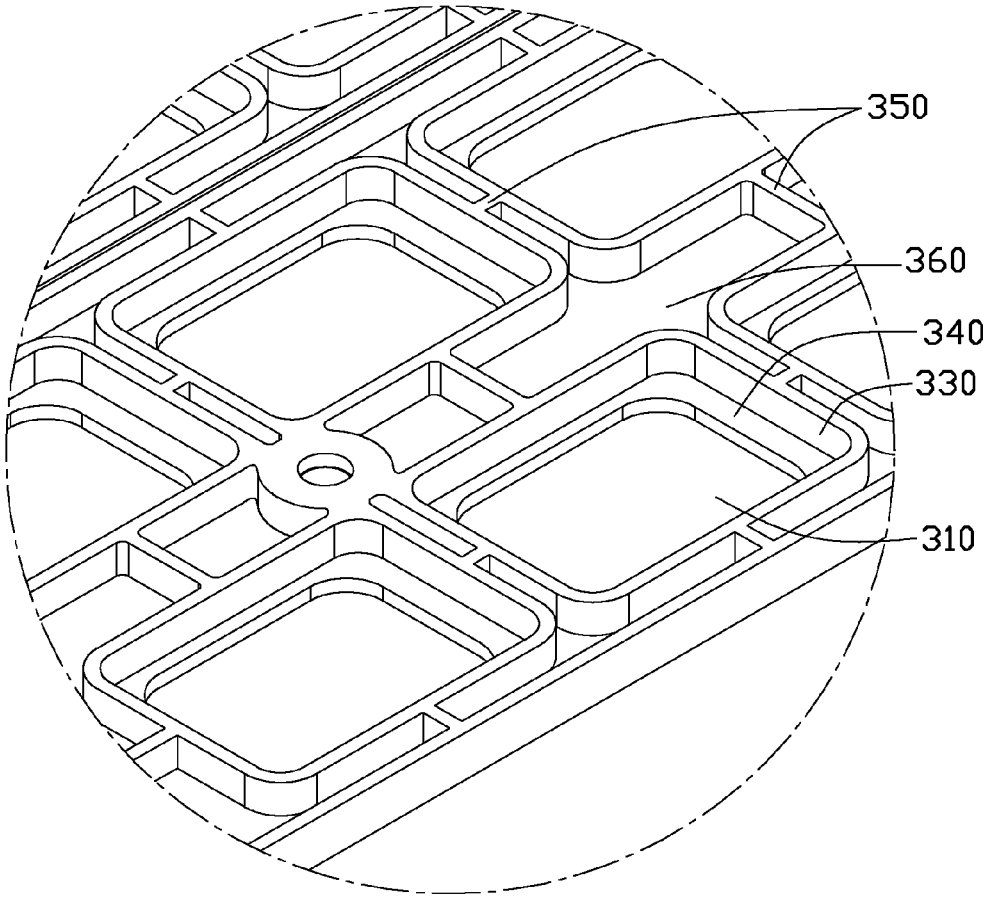
FIG. 5 is a partially enlarged view of a pressing plate of the LED assembly, taken from a circle V in FIG. 4.

Referring to FIGS. 4-5, the main bodies 302, 320 of the first, second pressing plates 30, 32 define a plurality of rectangular through holes 310. These through holes 310 are arranged in two rows corresponding to the two rows of the LEDs 12 of the LED module 11. The main bodies 302, 320 have a plurality of annular surrounding portions 330 corresponding to the through holes 310 extending downwards from bottom surfaces thereof. Each of the surrounding portions 330 spaces a distance from a corresponding through hole 310, whereby an accommodating groove 340 is formed between the corresponding through hole 310 and the surrounding portion 330 for receiving a peripheral portion of the supporting base 22 of the lens 20. A straight rib 350 is formed between two adjacent surrounding portions 330. The surrounding portions 330 and the ribs 350 may strengthen an integrity of the main body of the pressing plate 33. An amount of the rib 350 can be changed according to actual needs.

When the lenses 20 envelope the LEDs 12 of the LED modules 11, each of the through holes 310 of the pressing plate 33 is in alignment with a corresponding lens 20; at the same time, the pressing plate 33 presses downwards the lenses 20 on the printed circuit boards 10 in such a manner that the light adjusting portions 26 and the connecting portions 24 of the lenses 20 extend through the through holes 310 of the pressing plate 33. The peripheral portions of the supporting bases 22 are received in the accommodating grooves 340, and the top surfaces of the supporting bases 22 abuts the bottom surfaces of the main body of the pressing plate 33. In use of the LED assembly, in order to tightly press the lenses 20 on the printed circuit boards 10 of the LED modules 11, a plurality of fasteners 13 extend through the main body of the pressing plate 33 and the printed circuit boards 10 to engage with a heat dissipation device (not shown) or other components.

Each of the lenses 20 of the LED assembly cooperates with the corresponding LED 12 and is positioned with respect to the corresponding LED 12; at the same time, the cutouts 240 of the connecting portions 24 of the lenses 20 face a same lateral side of the LED assembly. Assembly error of the lens 20 and the corresponding LED 12 is kept within an allowable range and is not affected by other lenses 20, thereby reducing an influence of the assembly errors of the lenses 20 and the LEDs 12 on the light pattern of the LED assembly. Since the lenses 20 and the LEDs 12 are all precision parts, the assembly errors of the lenses 20 and the LEDs 12 can be kept within an expected range. On the basis, the pressing plate 33 tightly presses the lenses 20 on the printed circuit boards 10 of the LED modules 11 to prevent the lenses 20 from upwardly escaping from the LEDs 12, further ensuring the light pattern of the LED assembly. In addition, when the fasteners 13 secure the main body of the pressing plate 33 and the printed circuit boards 10 of the LED modules 11 on the heat dissipation device, the surrounding portions 330 and the ribs 350 of the pressing plate 33 can reduce the distortion of the main body of the pressing plate 33 to the minimum extent.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED assembly comprising:

a plurality of LED modules each having a printed circuit board and a plurality of LEDs attached to the printed circuit board;

a plurality of individual lenses cooperating with the LEDs, each lens comprising a supporting base and a light adjusting portion disposed on the supporting portion, each lens covering a corresponding LED; and a pressing plate defining a plurality of through holes corresponding to the light adjusting portions of the lenses;

wherein the light adjusting portions of the lenses extend through the through holes of the pressing plate, and the pressing plate presses peripheral portions of the supporting bases towards the printed circuit boards of the LED modules.

2. The LED assembly as claimed in claim 1, wherein each lens defines a first positioning groove at a bottom of the supporting base thereof, each LED comprising a base at a bottom thereof, the first positioning groove receiving a base of the corresponding LED to limit the base from moving in a plane parallel to a top surface of the printed circuit board to which the corresponding LED is attached and from rotating with respect to the first positioning groove.

3. The LED assembly as claimed in claim 2, wherein the first positioning groove is cooperatively formed by two crossed grooves, the base of the corresponding LED is selectively received in one of the crossed grooves for projecting light emitted from the corresponding LED along one of two different directions.

4. The LED assembly as claimed in claim 2, wherein a receiving groove is defined above and communicated with the first positioning groove and has two opposite elongated sides thereof expanding outwardly towards two opposite ends of the supporting base of the lens to form two second positioning grooves.

5. The LED assembly as claimed in claim 4, wherein each LED further comprises a substrate extending upwardly from a top surface of the base and an encapsulant enveloping a center of a top of the substrate, two opposite side portions of the substrate being received in the second positioning grooves, the encapsulant being received in the receiving groove.

6. The LED assembly as claimed in claim 1, wherein the pressing plate forms a surrounding portion surrounding a corresponding through hole thereof, the surrounding portion spacing a distance from the corresponding through hole, an accommodating groove being defined between the surrounding portion and the corresponding through hole for receiving a peripheral portion of the supporting base of a corresponding lens.

7. The LED assembly as claimed in claim 6, wherein a rib is disposed between two adjacent surrounding portions of the pressing plate for strengthening an integrity of the pressing plate.

8. The LED assembly as claimed in claim 1, wherein each lens further comprises a connecting portion connecting the supporting base and the light adjusting portion, the connecting portion being received a corresponding through hole.

9. The LED assembly as claimed in claim 8, wherein the connecting portion has a cutout defined at a side thereof for identifying correct assembly orientation of the lens.

10. The LED assembly as claimed in claim 1, wherein the supporting base has two cutouts defined at two opposite short sides thereof for avoiding interference with other elements.

* * * * *